United States Patent [19]

Runyon

[11] Patent Number: 4,876,831

[45] Date of Patent: Oct. 31, 1989

[54] FOLDING MODULAR BUILDING STRUCTURE

[76] Inventor: John F. Runyon, 91 Kent St., Apt. 4, St. Paul, Minn. 55102

[21] Appl. No.: 167,885

[22] Filed: Mar. 14, 1988

[51] Int. Cl.[4] ..... E04B 1/346

[52] U.S. Cl. ..... 52/70; 52/86; 52/81; 52/DIG. 10; 52/646

[58] Field of Search ..... 52/71, 86, DIG. 10, 52/81, 646

[56] References Cited

U.S. PATENT DOCUMENTS

| | | | |
|---|---|---|---|
| 3,501,876 | 3/1970 | Engle | 52/86 |
| 3,766,932 | 10/1973 | Sidis | 52/DIG. 10 |
| 3,973,370 | 8/1976 | McAllister | 52/86 |
| 4,145,850 | 3/1979 | Runyon | 52/71 |
| 4,404,240 | 9/1983 | Varela | 52/DIG. 10 |
| 4,539,786 | 9/1985 | Nelson | 52/DIG. 10 |

*Primary Examiner*—Henry E. Raduazo

*Attorney, Agent, or Firm*—Burd, Bartz & Gutenkauf

[57] ABSTRACT

An improved folding dome-like modular building structure composed of 48 flexibly interconnected equal right isoceles triangles. Each building structure is formed from a series of four flexibly connected modules of 12 triangles each. The modules are connected in alternating right and left-handed mirror image sequence. Each triangle is defined by struts. The improvements lie in the provision of intermediate cuts and hinged joints in certain of the struts to facilitate folding of the structure into a compact mass. Variations of the basic building structure are disclosed. The building structures may be open or partially open framework or they may be enclosed by a fabric or film covering.

18 Claims, 6 Drawing Sheets

FIG. 18
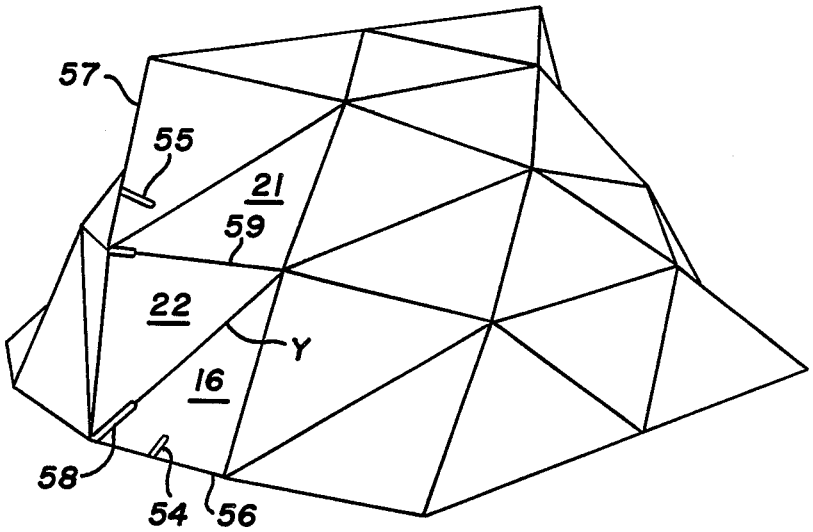
FIG. 19
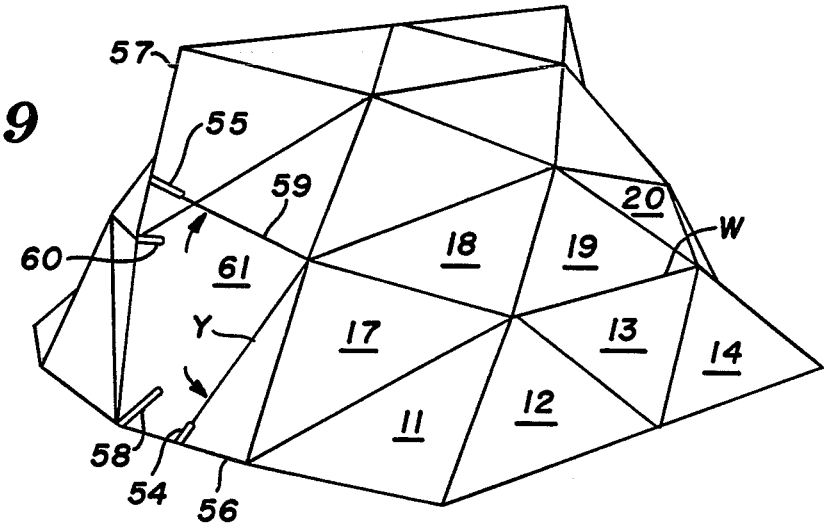
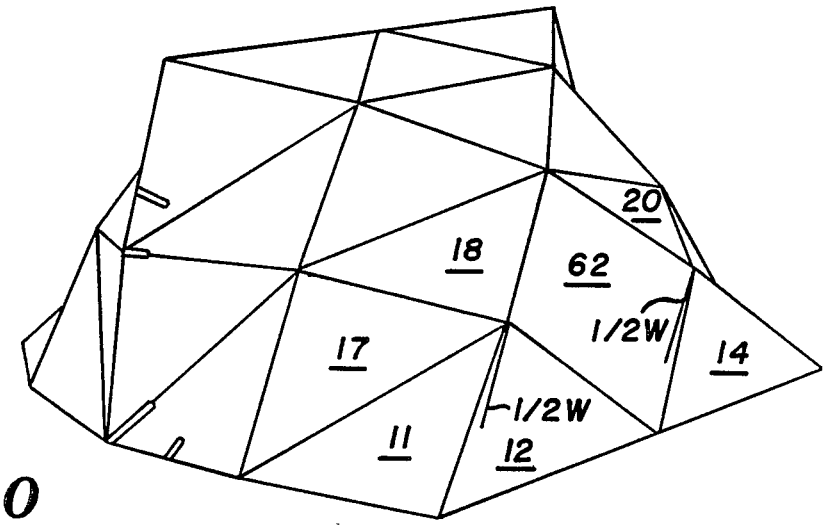
FIG. 20

FOLDING MODULAR BUILDING STRUCTURE

BACKGROUND OF THE INVENTION

1. Field of the Invention

This invention is directed to folding dome-like modular building structures for the construction of buildings without internal supporting pillars or other similar major structural supports which form interior obstructions. Because of the ease with which the buildings are assembled and disassembled, structures built according to the present invention are especially adapted for such uses as temporary shelters, storage buildings, exhibition buildings for use at fairs, trade shows, and the like, etc.

2. The Prior Art

In my prior U.S. Pat. No. 4,145,850, issued Mar. 27, 1979, there is shown a folding dome-like modular building structure composed of 48 flexibly interconnected right isosceles triangles. Each building structure is formed from a series of four flexibly connected modules of 12 triangles each. The modules are connected in alternating right and left handed structural mirror image sequence. Each triangle may be a rigid panel or an open space enclosed by struts or panel edges. The structure may be formed in part from struts and in part from panels. It may be an open or partially open framework or it may be enclosed by fabric or film supported over or suspended from the framework.

In one embodiment of the invention of my prior patent, wherein the building framework is constructed in part of flexibly connected struts, the building framework may be collapsed and folded into a relatively compact package for moving or storage by the removal of or hinging of certain of the struts comprising the triangular structural components.

The present invention represents an improvement over that of my prior patent. It is the principal object of this invention to make folding modular building structures easier to store and transport by permitting the structure to be folded to a more compact configuration than previously possible. A secondary object is to make the structures easier to cover and to enter, by adding or adjusting struts.

SUMMARY OF THE INVENTION

Broadly stated, the present invention is directed to a folding modular building structure composed of four flexibly interconnected structural modules. Each of the modules is composed of a plurality of hinged structural elements defining 12 equal spaced right isosceles triangular components. Each of the triangular components is a flat right isosceles triangle formed from a series of rigid struts or rods. Each of the modules, if laid flat, defines a tapezoid. The hypotenuses of the triangles forming the trapezoid are parallel defining a long base and a short base, or top edge, and an intermediate parallel line between the long base and top edge and parallel thereto. There are two right handed modules and two left handed modules. The modules are connected along their parallel bases and sides in repeating right and left handed mirror image form with each right handed module being adjacent to a left handed module. Thus, the components forming the top edge and two sides of the trapezoidal module are connected to the components forming the top edge and two sides of the next adjacent trapezoidal module. The components defining the long base of that module are connected to the corresponding components defining the long base of the next module, etc.

In the building structure of the present invention, all of the rigid structural elements are composed of linear strut-like elements flexibly connected at their ends point-to-point to like linear elements. Greater foldability and resulting greater compactness of the building structure are achieved by virtue of the improvement which consists in each of those struts comprising the hypotenuses of the right triangular components being either severed and reversibly separable, i.e., reattachable, or flexibly hinged at a point intermediate of their ends, in a predetermined symmetrical pattern of cuts and hinges.

BRIEF DESCRIPTION OF THE DRAWINGS

The invention is illustrated by the accompanying drawings in which corresponding parts are identified by the same numerals and in which:

FIGS. 15 through 23 are perspective views of alternative assembled structures according to the present invention.

DETAILED DESCRIPTION OF THE PREFERRED EMBODIMENT

Figure 1:
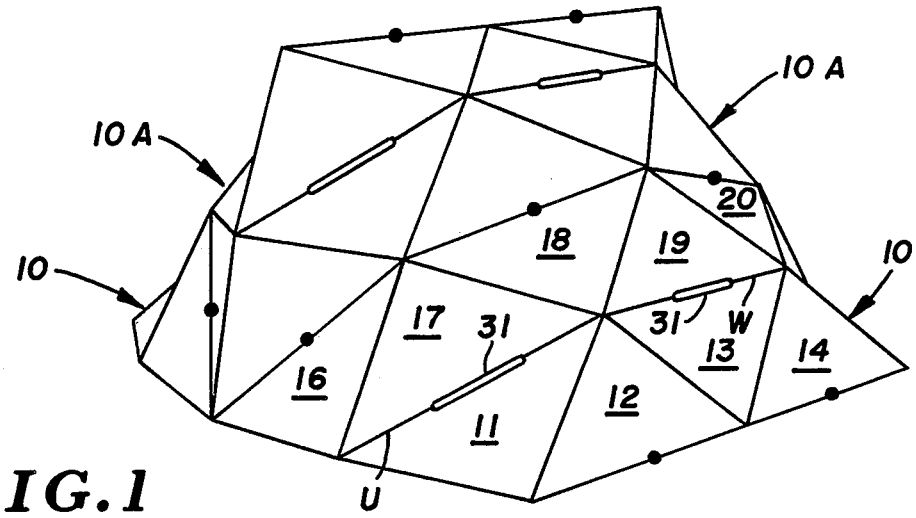
FIG. 1 is a schematic perspective view showing one form of improved folding modular building structure according to the present invention in assembled form.
Figure 2:
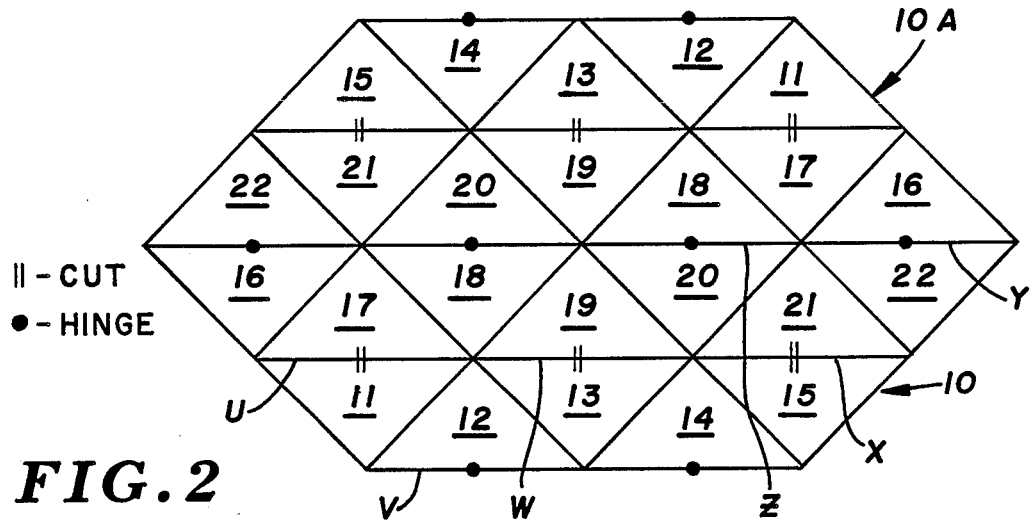
FIG. 2 shows a double module skeleton from which the buiding structure is formed shown laid flat.

Referring now to the drawings, and particularly to Figure 2, there is shown in plan view a double module 10 composed of a pair of identical trapezoidal skeletons connected in structural mirror image relation. The structure shown in FIG. 1 is assembled from two such double modules. Each flat single module forms a trapezoid consisting of 12 equal sized right isosceles triangles 11–22 with all hypotenuses parallel. Each of the modules is formed from a plurality of flexibly connected rigid struts or rods. Preferably the struts are in the form of rigid tubes, such as aluminum, for example, although some of the struts may be solid, such as wooden dowels or fiberglass rods or the like. The triangular components are flexibly connected together point-to-point by means of hinged joint assemblies, as descibed in greater detail hereinafter.

In assembling a building, four identical modules are flexibly connected together, two in right hand configuration and two in mirror image left hand configuration. Thus, a module 10 is connected to a similar module 10A in structural mirror image along the long bases of the trapezoidal modules when laid flat. The hypotenuses of the triangular components 16 and 18 of both modules share a common edge with the hypotenuses of triangular components 22 and 20, respectively, of the next module. Two double module units are assembled with triangular components 12 and 14 abutting and sharing common hypotenuses. To construct a building structure as shown in FIG. 1, the skeleton is folded to bring the side edges of triangular components 11 and 16 of the innermost pair of modules into abutment with the side edges of triangular components 15 and 22, respectively.

Figure 3:
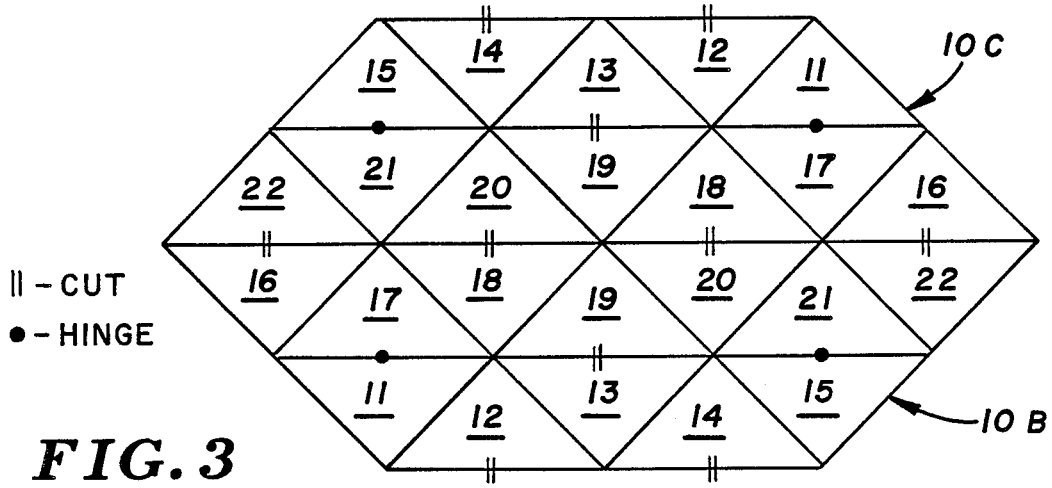
FIG. 3 shows an alternative form of similar double module skeleton laid flat.
Figure 4:
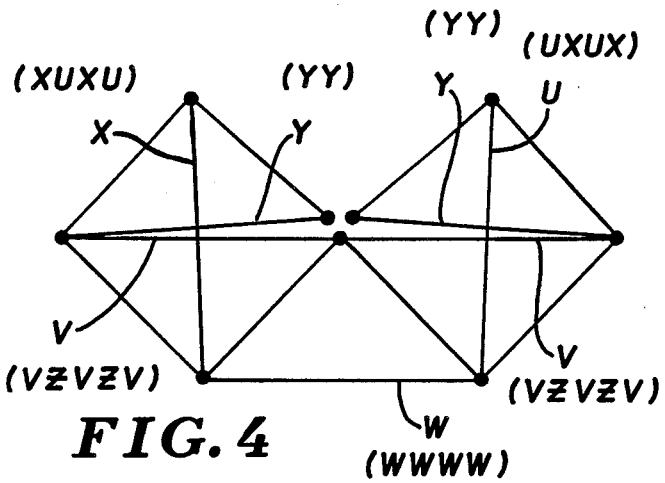
FIGS. 4 through 10 show in schematic form the successive steps by which the building structure may be folded to collapsed form shown in FIG. 10.

FIGS. 3 through 8 of U.S. Pat. No. 4,145,850 show the successive steps by which the structure of FIG. 1 herein may be collapsed and folded. FIG. 4 herein (corresponding to FIG. 8 of the aforesaid patent) represents the smallest folded configuration of the building structure which is possible when each of the struts defining a triangular component is a unitary element. As described in the aforesaid patent, and illustrated in FIG. 9 thereof, a slightly smaller folded configuration can be achieved by hinging or removing the strut representing the hypotenuse between triangular components 13 and 19. The present invention is based upon the discovery that further compactness of the folded structure is possible by making all of the struts representing the hypotenuses of the right triangular building components either separable or flexibly hinged at their mid-points in a predetermined pattern as illustrated in FIG. 2, or in an alternative pattern as shown in FIG. 3.

Figure 8:
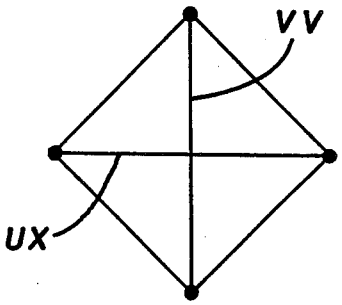
Figure 9:
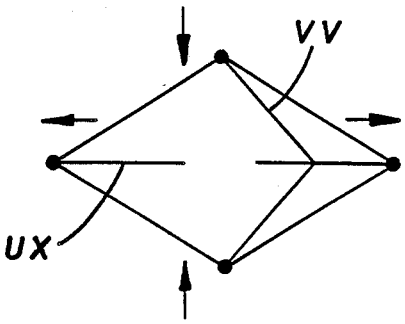
Figure 10:
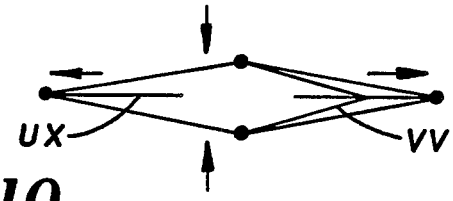

Referring now to FIGS. 4 through 10, there are shown in schematic form the successive steps by which the structure is folded to the compact assembly shown in FIG. 10. For clarity, the struts defining the hypotenuses between abutting triangular components and shared by them are designated in FIG. 2 according to the following table:

| STRUT (HYPOTENUSE) | BETWEEN TRIANGULAR COMPONENTS |
|---|---|
| U | 11–17 |
| V | 12–14 |
| W | 13–19 |
| X | 15–21 |
| Y | 16–22 |
| Z | 18–20 |

FIG. 4 represents a planview looking down upon struts stacked and thus superimposed one upon the other in number from two to five. Thus, another strut X and two struts U in the order X-U-X-U underlie strut X shown. Another strut Y underlies each of the struts Y shown. Two struts X and another strut U in the order U-X-U-X underlie strut U shown. Two struts Z and two other struts V in the order V-Z-V-Z-V underlie the structs V shown, and three other struts W underlie the strut W shown. For comparision, FIG. 7 of the aforesaid U.S. Pat. No. 4,145,850 shows the triangular components as panels.

Figure 5:
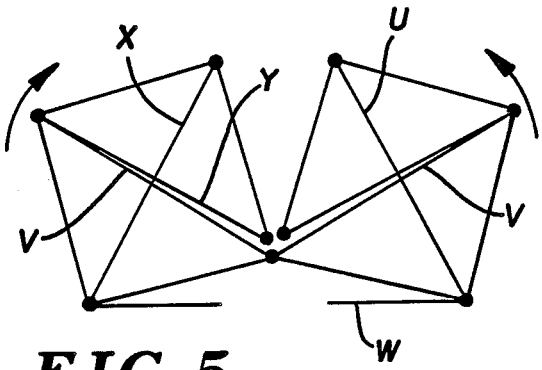
Figure 6:
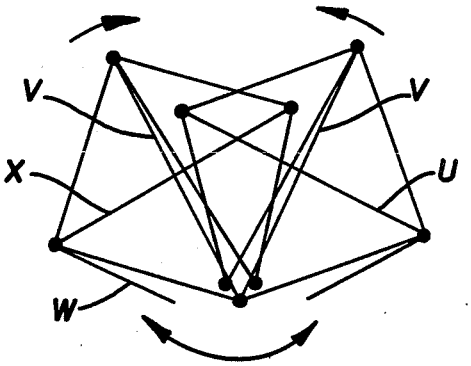
Figure 7:
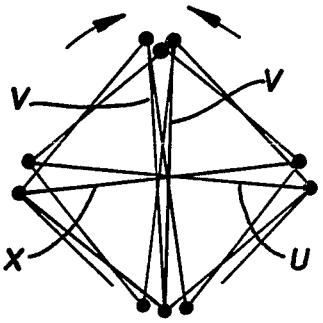

Referring now to FIG. 5, as the next step n folding the collapsed assembly into more compact form, structs W are cut at their mid-points so that the left and right halves of the folded structure can start folding toward each other. As shown in FIG. 6, the left and right halves overlap as folding continues to the generally square shape shown in FIG. 7, which is replaced with the simplified schematic square of FIG. 8. In the folded square configuration of FIG. 8 struts V, Y and Z are stacked and lie along the vertical line VV crossing at the center at nine levels in the pattern V-YZ-V-YZ-V, V-YZ-V-YZ-V. Struts U and X lie along the horizontal line UX stacked eight struts high perpendicular to and alternating beween the struts lying along the vertical line.

Referring again to the schematic of FIG. 4, strut V shown in the left hand overlies four additional struts and represents the five struts V-Z-V-Z-V lying at five levels. Strut Y shown in the left hand overlies another strut Y. The struts Y are connected to and lie beside two struts Z. The five levels of struts contain the struts V-YZ-V-YZ-V. When the left and right halves are overlapped, these struts lie on top of an identical series from the right half, so they stack in nine levels (at the center where other struts cross) in the pattern V-YZ-V-YZ-V, V-YZ-V-YZ-V.

Referring to FIG. 9, if in addition to cutting the struts W, the eight struts U and X lying along horizontal line UX of FIG. 8 are cut, and the fourteen struts V, Y and Z lying along the vertical line VV of FIG. 8 are hinged at mid-point (in the configuration shown in FIG. 2) further folding and collapse of the structure is possible, as shown in FIG. 10. Alternatively, a similar collapsed structure may be achieved by locating the cuts and mid-point hinges in the configuration shown in FIG. 3. Here, struts W are cut, as previously described. Struts U and X are hinged at their mid-points and struts V, Y and Z are cut.

Figure 12:
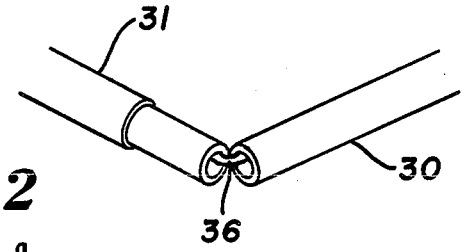
FIG. 12 shows one form of mid-strut hinge joint.

As shown schematically in FIG. 1 and structurally in FIG. 12, each cut tubular strut, indicated at 30, funtioning as a hinge, is provided with a strengthening reciprocable alignment sleeve 31 which maintains the structure rigid when assembled and slides away from the cut portion to permit folding and collapse of the structure.

Figure 11:
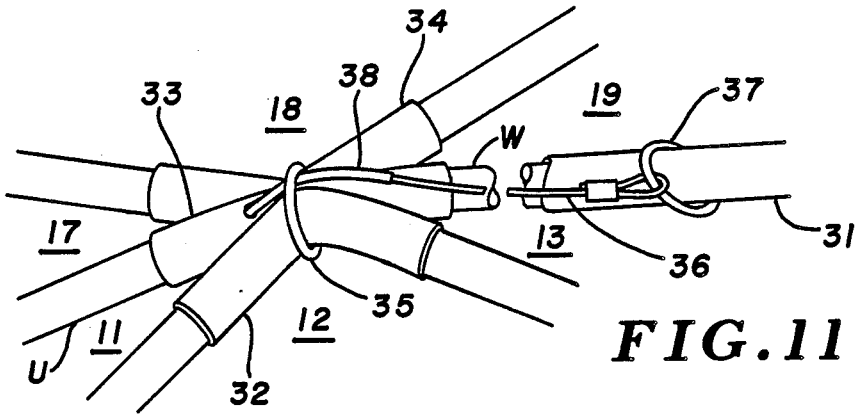
FIG. 11 shows in perspective view one form of flexible joint by which the building structure components may be assembled according to the present invention.

It will be noted that the struts U, W and X dividing each module 10 are in longitudinal alignment and this series is repeated four times in the assembled structure. A form of hinged joint by which strut W may be connected to strut U and to strut X is shown in FIG. 11. This is repeated in mirror image on the three other modules for a total of eight joints. Each such hinged joint is composed of flexible tubular segments of rubber or synthetic resinous rubber-like material 32, 33 and 34, held together at their mid-sections by ring 35. A cable 36 whose end is anchored at the far end of cut strut U extends through the entire strut and emerges at the hinge joint. The cable 36 then runs outside along the middle strut W terminating at a ring 37 which is large enough to loosely encircle the strut W and its alignment sleeve 31. Preferably a length of small diameter tubing 38, such as nylon, passes under the joint ring 35 and through a hole in the flexible joint tubing 33 to reach the hollow core of strut U to serve as a low friction guide for the cable 36. Ring 37 and the corresponding ring from the joint assembly at the opposite end of strut W are drawn together from opposite ends and fastened to each other at the mid-point of strut W with a simple hook. The cables 36 are thus drawn taut, holding each series of three struts U, W and X together end to end. The cables take tension loads so that the alignment sleeves 31 need only restrain each strut from bending where it has been cut.

FIG. 12 illustrates a simple form of hinge joint which may be used at the mid-points of the remaining fourteen hinged struts V, Y and Z. A cable the same length as the strut is placed in its hollow core and anchored to each end of the strut segments. The cable serves as a hinge by stretching slightly to allow the two halves to pivot without coming apart. The alignment sleeve can be slid over the cut in the strut to lock the two halves in line.

Elastic cord, such as so-called Bunge cord, can be similarly placed in the core of the cut struts W so that the cut ends remain paired despite the separation shown in Figure 5. The elastic cord then also retains the sliding alignment sleeves.

The cut ends of the eight struts UX indicated in FIG. 10 can remain paired and their alignment sleeves retained by sliding cables in their cores. Optionally, the alignment sleeves of the cut struts may be secured adhesively or otherwise to one of the two strut halves, preventing mispositioning.

Figure 13:
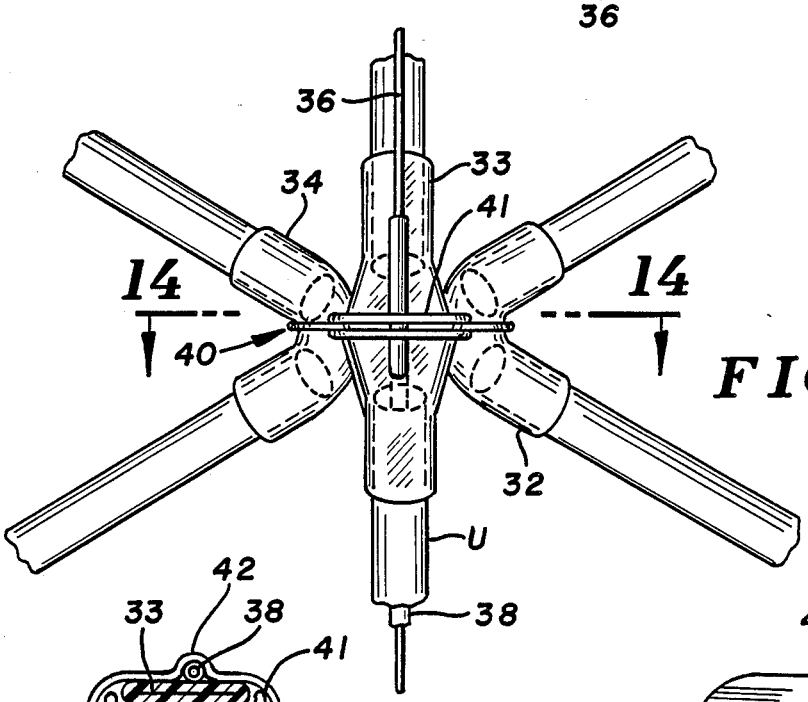
FIG. 13 is a plan view of an alternative form of flexible assembly joint.
Figure 14:
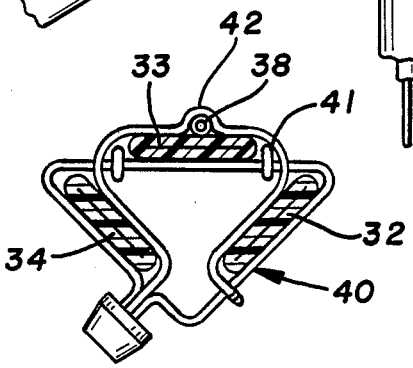
FIG. 14 is a section on the line 14—14 of FIG. 13.
Figure 14A:
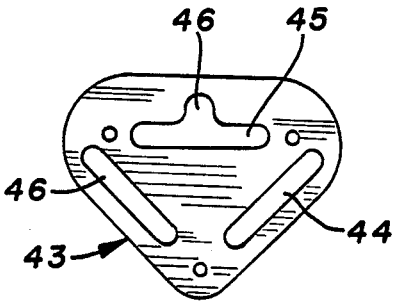
FIG. 14A shows a further alternative form which can replace the assembly joint body of FIG. 14.

Referring to FIGS. 13 and 14, there is shown a modified form of flexible hinge joint according to my prior U.S. Pat. No. 4,285,609. The hinge joint is similar in most respects to that described in connection with FIG. 11 except for the hinge body or hub indicated generally at 40 whose structure is described in detail in the aforesaid patent. The base elements 41 thereof are provided with a central arcuate protruding loop 42 to accommodate low friction cable tube 38. FIG. 14A shows another form of hinge or hub body having slots 44–46 for receiving tubing segments 32–34, respectively. Slot 45 is modified to include detent 46 to accommodate cable tube 38.

Figure 15:
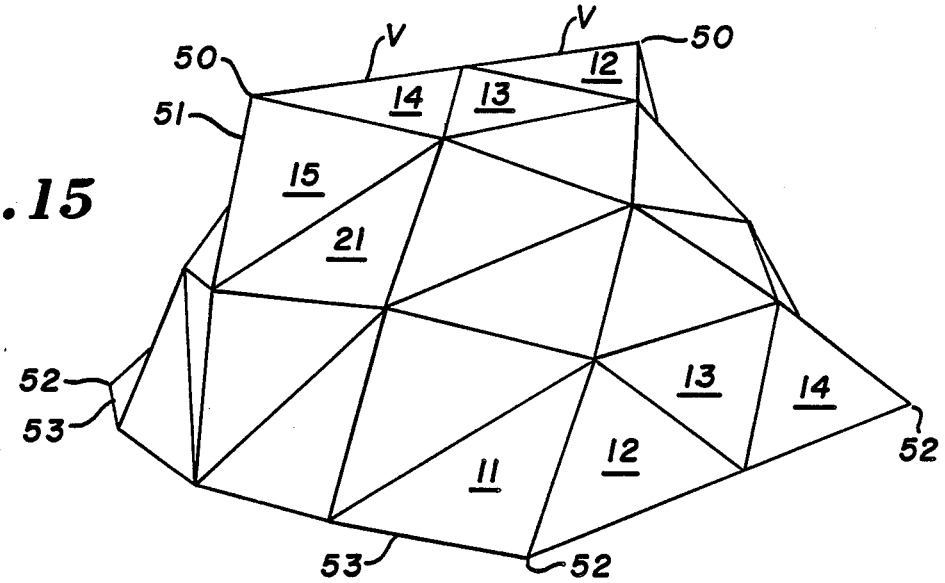
Figure 16:
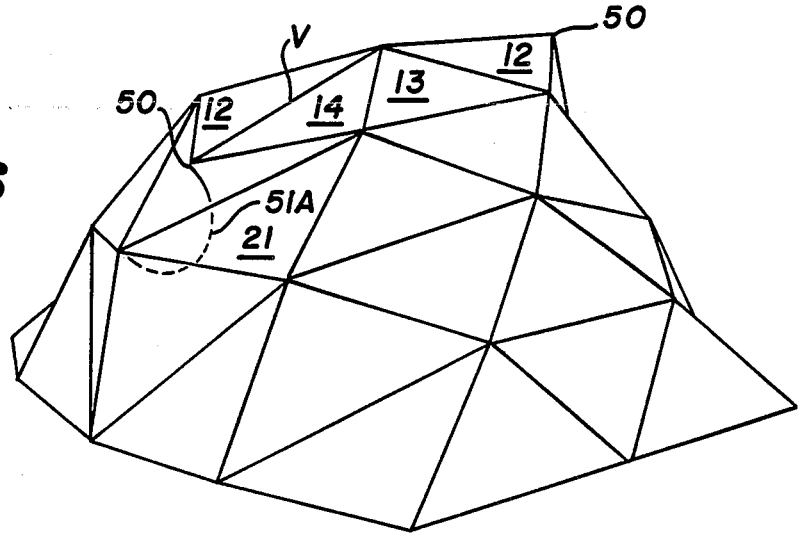
Figure 17:
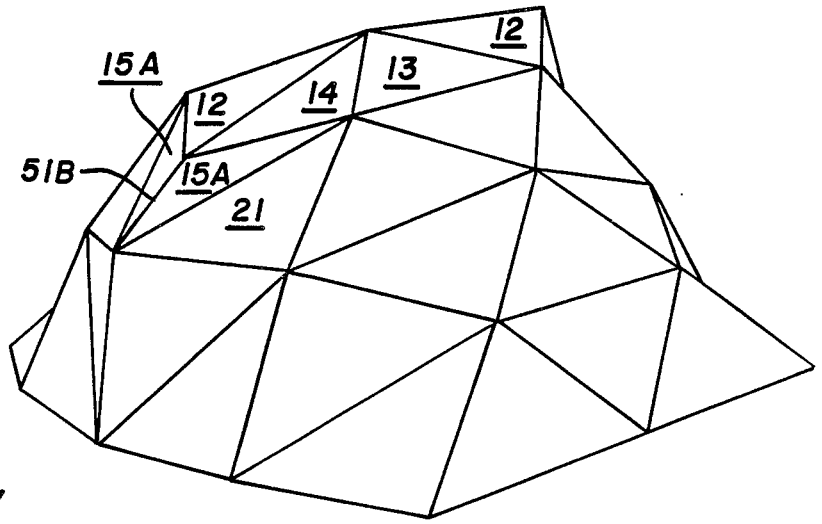

FIG. 15 shows the structure of FIG. 1 in schematic form without the hinged struts and alignment sleeves shown. The vertices 50 lie at the opposite ends of the natural ridge line formed by the two horizontal struts V extending between these vertices at the center top of the structure. The two vertices 50 may be used to fasten a cover added after the framework is erected and to hold guides or pulleys through which may pass lines to raise or lower the cover perimeter for ventilation or other purposes. If the nearly vertical strut 51 attached to each vertex 50 is replaced with a stiff but resilient strut 51A, then that strut may be bowed as shown in FIG. 16 to temporarily pull the end of the ridge line lower for ease in fastening a cover or lines, etc. Alternatively, if strut 51 is replaced by a telescoped or shortened strut 51B, as indicated in FIG. 17, the vertex 50 can remain lowered giving a more rounded dome-like appearance to that part of the structure. The triangular spaces 15A which share the shortened strut 51B for one of their sides are now different from the identical right isosceles triangles 11-22 (each one-half of a square) forming the remainder of the structure.

Four vertices 52 at ground level (FIG. 15), three of which are visible, are symmetrical with the two top vertices 50. Struts 53 may also be telescoping, or each of vertices 52 may receive a shortened strut to replace struts 53 to produce a more rounded dome-like appearance. The covers for such modified structures including shortened struts must also be modified by removing material equal to the decrease in size of the affected triangular areas.

FIG. 18 shows the scehmatic structure of FIG. 15 with two sockets 54 and 55 added intermediate of the ends of the struts 56 and 57, respectively. As shown in FIG. 19, this permits strut Y between triangular components 16 and 22 to be removed from socket 58 of its normal connecting joint and inserted in socket 54. Similarly, it permits strut 59 defining one edge of triangular component 21 to be removed from its normal connecting socket 60 and inserted in socket 55. The overall structure does not change shape except for the two relocated struts. The socket lengths are adjusted to give the effective assembled strut length required for both relocated positions. The two socket connections 54 and 55 along the lengths of struts 56 and 57, respectively, do not produce unmanageable bending forces in those struts but do allow a larger entrance opening 61. An alternative form of entrance opening 62 is shown in FIG. 20 where the cut halves of strut W between triangular components 13 and 19 (which is already cut to allow compact folding of the structure) are swung down to ground level to act as braces for the joints to which they are attached.

Figure 21:
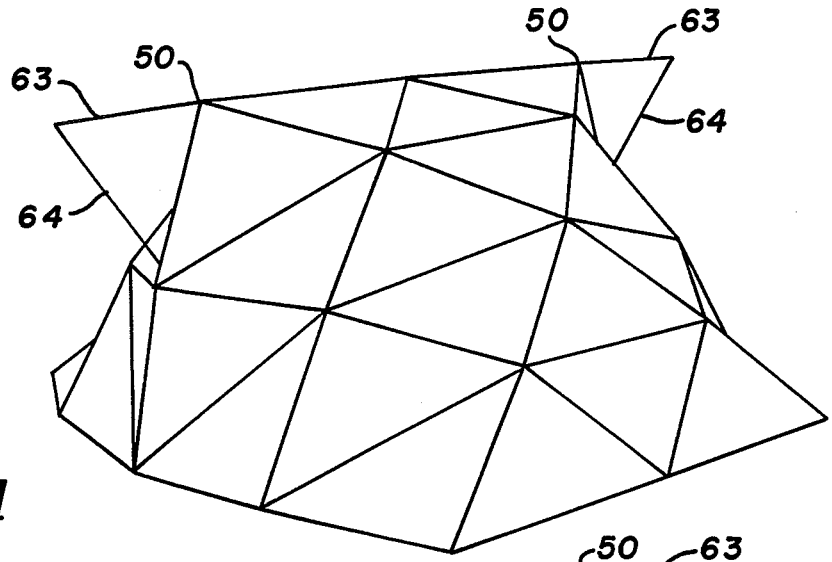
Figure 22:
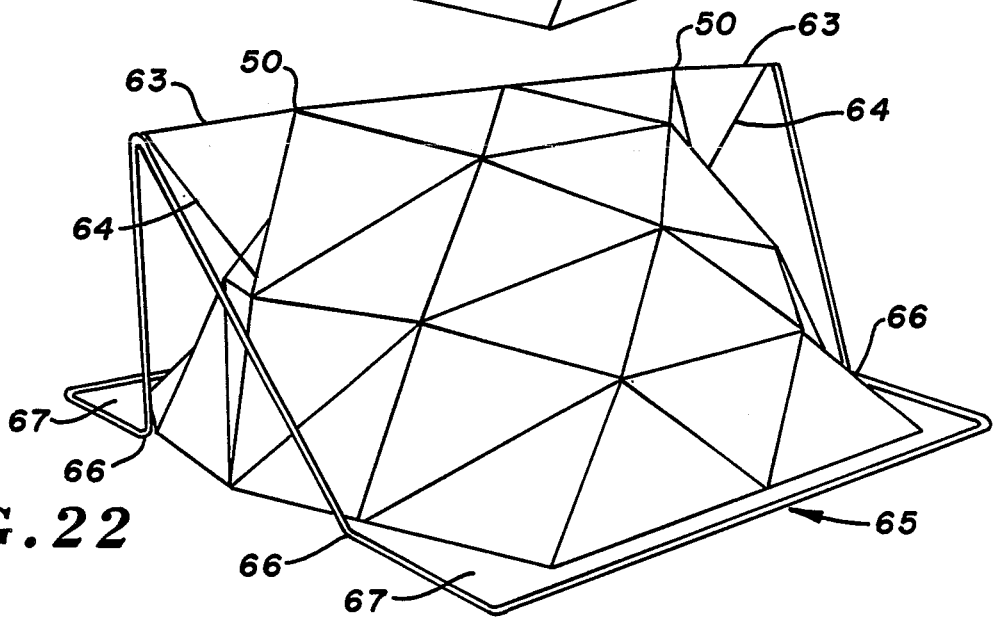

The basic structure of FIG. 15 is shown in FIG. 21 with an additional horizontal strut 63 and brace strut 64 at each of the vertices 50 at opposite ends of the ridge line. These additional struts form extensions of the ridge so that the structure frame may be covered by a large rectangular sheet, indicated generally at 65, shown as if transparent, and outlined by a double line border, as shown in FIG. 22. The cover is supported by the ridge line and may be held taut by attachment to the ground at four points 66, three of which are visible in FIG. 22. Extra cover material lies on the ground at the corners 67. The rectangular cover shown is about three long struts in width along the ridge line and four long struts in length perpendicular to the ridge line. If the cover is made square with sides four long struts in length, even more material will lie on the ground at the corners. However, excess material can be removed at the corners by making the square into a regular octagon with the four original edges reduced in length to two long struts each (thus the four corners removed are right triangles dimensioned one long strut length on their short sides.)

Figure 23:
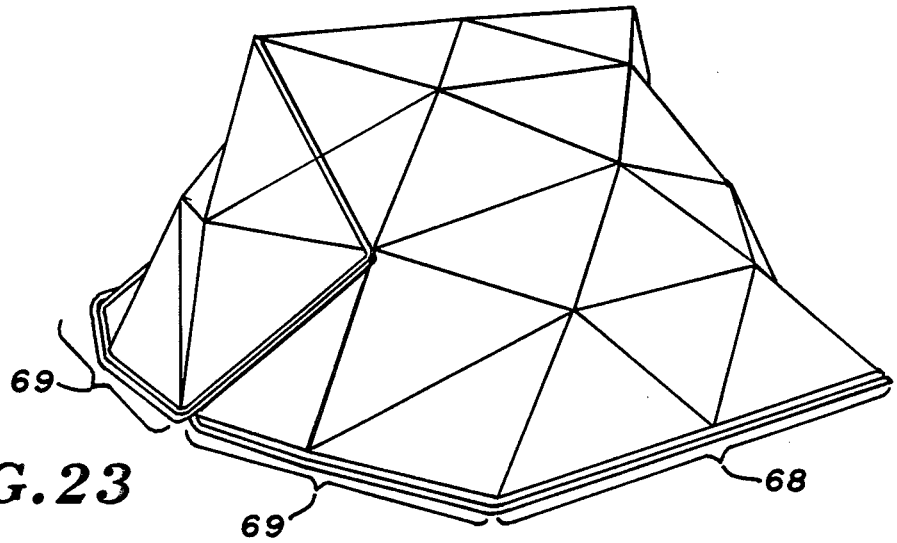

If the ridge extensions of FIG. 21 are removed, such an octagonal cover can be pulled closely around the structure by attachment at its ground perimeter to form a tight fitting cover, as shown in FIG. 23. The octagonal cover has excess material extending out only at the ends of the ridge line, coming together as a double layer which can then be laid flat against the structure. As seen in FIG. 23, one octagonal cover side is attached along length 68. Two octagonal cover corners are attached along two lengths 69. Two additional lengths 69 and another length 68 complete the perimeter hidden from view opposite those which are visible.

If maximum folding and compactness are not required, the modifications of FIGS. 16–22 may be incorporated into the structures of aforesaid U.S. Pat. No. 4,145,850.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. In a folding building structure comprised of a plurality of flexibly interconnected structrual modules, (A) each of said modules comprised of a plurality of hinged structural elements defining twelve equal sized right isosceles triangular components, (B) each of said modules, if laid flat, defining a trapezoid, the hypotenuses of the triangles forming the trapezoid being parallel, (C) each of said trapezoidal modules including a first row of five triangular components and a second row of seven triangular components, (D) the hypotenuses of two of said two triangular components in said first row defining the top edge of the trapezoidal module, (E) the hypotenuses of four of said triangular components in said second row defining the base of the trapezoidal module, (F) the shared hypotenuses of the remaining three triangular components of said first row and the remaining three triangular components of said second row defining an intermediate line parallel to and midway between the top edge and base of the trapezoidal module, (G) said interconnected modules being disposed in repeating right and left-handed mirror image form, each right handed module being adjacent to a left-handed module, and (H) said structural elements being composed of linear strut-like elements flexibly connected at their ends point-to-point to like linear elements, the improvement which consists in:

the hyppotenuses defining the top edges and bases of said trapezoidal modules being hinged and the hypotenuses defining the alternating intermediate lines of said trapezoidal modules being severed and reversibly separable, i.e., reattachable.

2. In a folding modular building structure comprised of a plurality of flexibly interconnected structural modules, (A) each of said modules comprised of a plurality of hinged structural elements defining twelve equal sized right isosceles triangular components, (B) each of said modules, if laid flat, defining a trapezoid, the hypotenuses of the triangles forming the trapezoid being parallel, (C) each of said trapezoidal modules including a first row of five triangular components and a second row of seven triangular components, (D) the hypotenuses of said triangular components in said first row defining the top edge of the trapezoidal module, (E) the hypotenuses of four of said triangular components in said second row defining the base of the trapezoidal module, (F) the shared hypotenuses of the remaining three triangular components of said first row and the remaining three triangular components of said second row defining an intermediate line parallel to and midway between the top edge and base of the trapezoidal module, (G) said interconnected modules being disposed in repeating right and left-handed mirror image form, each right-handed module being adjacent to a left-handed module, and (H) said structural elements being composed of linear strut-like elements flexibly connected at their ends point-to-point to like linear elements, the improvement which consists in:

the hypotenuses defining the top edges and bases of said trapezoidal modules being severed and reversibly separable, i.e., reattachable, the middle hypotenuses contained in the alternating intermediate lines of said trapezoidal modules being severed and reversibly separable, and the end hypotenuses defining the intermediate lines of said trapezoidal modules being hinged.

3. A folding modular building structure according to claims 1 or 2 wherein:

(A) said severed and reversibly separable component hypotenuses are tubular and composed of two segments, and (B) a reciprocable alignment sleeve is fit, with a close slide fit over one of the segments of each severed hypotenuse.

4. A folding modular building structure according to claim 3 wherein a flexible line extends through each of said tubular segments.

5. A folding modular building structure according to claim 4 wherein said flexible line is a cable.

6. A folding modular building structure according to claim 4 wherein said flexible line is an elastic cord.

7. A folding modular building structure according to claims 1 or 2 wherein:

(A) said flexibly hinged component hypotenuses are tubular and severed at their mid-sections into two segments, (B) a reciprocable alignment sleeve is fit with a close slide fit over one of the segments of each severed hypotenuse, and (C) a taut flexible line is anchored in each of said segments.

8. A folding modular building structure according to claim 7 wherein said flexible line is a cable.

9. A folding modular building structure according to claims 1 or 2 wherein:

(A) said structure is composed of two pairs of alternating modules, (B) the shared hypotenuses of the triangular components of abutting pairs of modules define a ridge line of the structure, having vertices formed by converging triangular components at each end, and generally vertical strut-like elements extending downward from each opposite end of the ridge line, and (C) the generally vertical strut-like element extending downwardly from each opposite end of the ridge line is stiff but flexible and bendable.

10. A folding modular building structure according to claims 1 or 2 wherein:

(A) said structure is composed of two pairs of alternating modules, (B) the shared hypotenuses of the base triangular components of abutting pairs of modules define a ridge line of the structure, having vertices formed by converging components at each end, and generally vertical strut-like elements extending downwardly from each opposite end of the ridge line, and (C) the generally vertical strut-like element extending downwardly from each opposite end of the ridge line is capable of being foreshortened, whereby the ends of the ridge line may be deflected downwardly, imparting a more rounded dome-like profile to the structure.

11. A folding modular building structure according to claim 1, wherein said foreshortenable strut-like elements are telescoping.

12. A folding modular building structure according to claims 1 o 2 wherein:

(A) said structure is composed of two pairs of alternating modules.

(B) at least some of the strut-like elements comprising the nonparallel trapezoidal edges of the two outermost modules, which engage the supporting surface for the building structure, are capable of being foreshortened, whereby the perimeter of the structure may be shortened, imparting a more rounded dome-like plan to the structure.

13. A folding modular building structure according to claim 12 wherein said foreshortened strut-like elements are telescoping.

14. A folding modular building structure according to claim 1 or 2 wherein:

(A) said structure is comprised of two pairs of alternating modules, (B) the shared hypotenuses of the triangular components of abutting pairs of modules define a ridge line of the structure, having vertices formed by converging triangular components at each end, and a generally vertical strut-like element extending downwardly from each opposite end of the ridge line, and (C) a horizontal extension strut-like element is secured to each opposite end of said ridge line in axial alignment therewith, and (D) a brace strut-like element is secured to each extension strut-like element and to the generally vertical strut-like element extending downward from each opposite end of the ridge line.

15. A folding modular building structure according to claims 1 or 2 wherein:

(A) said structure is comprised of two pairs of alternating modules, (B) the shared hypotenuses of the triangular components of abutting pairs of modules define a ridge line of the structure, having vertices formed by converging triangular components at each end, and a generally vertical strut-like element extending downwardly from each opposite end of the ridge line, and (C) an auxiliary strut-like element engaging flexible joint socket is secured to the generally vertical strut-like element extending downwardly from one end of the ridge line, and (D) a furher auxiliary strut-like element engaging flexible joint socket is secured to one of the ground engaging strut-like elements immediately adjacent to the lateral mid-section of the structure underlying the ridge line, whereby, by displacing strut-like elements from their normal interconnecting flexible assembly joints to said auxiliary sockets, an enlarged entry opening is formed.

16. In a folding modular building structure comprised of a plurality of flexibly interconnected structural modules, (A) each of said modules comprised of a plurality of hinged structural elements defining twelve equal sized right isosceles triangular components, (B) each of said modules, if laid flat, defining a trapezoid, the hypotenuses of the triangles forming the trapezoid being parallel, (C) each of said trapezoidal modules including a firs row of five triangular components and a second row of seven triangular components, (D) the hypotenuses of two of said triangular components in said first row defining the top edge of the trapezoidal module, (E) the hypotenuses of four of said triangular components in said second row defining the base of the trapezoidal module, (F) the shared hypotenuses of the remaining three triangular components of said first row and the remaining three triangular components of said second row defining an intermediate line parallel to and midway between the top edge and base of the trapezoidal module, (G) said interconnected modules being disposed in repeating right and left-handed mirror image form, each right-handed module being adjacent to a left-handed module, and (H) said rigid structural elements being composed of linear strut-like elements flexibly connected at their ends point-to-point to like linear elements, the improvement which consists in:

the middle hypotenuses defining the intermediate lines of said trapezoidal modules being severed and reversibly separable, i.e., reattachable.

17. A folding modular building structure according to claim 18 wherein:

(A) said severed and reversibly separable component hypotenuses are composed of tubular segments, and (B) a reciprocable alignment sleeve is fit with a close slide fit over one of the segments of each severed hypotenuse.

18. A folding modular building structure according to claim 17 wherein the elastic cord extends through each of said severed tubular segments.

* * * * *

UNITED STATES PATENT AND TRADEMARK OFFICE

CERTIFICATE OF CORRECTION

PATENT NO. : 4,876,831

DATED : October 31, 1989

INVENTOR(S) : John F. Runyon

It is certified that error appears in the above-identified patent and that said Letters Patent is hereby corrected as shown below:

Column 3, line 56, "n" should be --- in ---
Column 4, line 6, "hand" should be --- half ---
Column 5, line 56, "scehmatic" should be --- schematic ---
Column 8, line 47, --- triangular --- should be inserted before "components"
Column 8, line 58, "1" should be --- 10 ---
Column 8, line 61, "o" should be --- or ---
Column 9, line 7, "claim" should be --- claims ---
Column 9, line 22, "downward" should be --- downwardly ---
Column 9, line 40, "furher" should be --- further ---
Column 10, line 10, "firs" should be --- first ---
Column 10, line 37, "18" should be --- 16 ---

Signed and Sealed this

Seventh Day of April, 1992

*Attest:*

*Attesting Officer*

HARRY F. MANBECK, JR.

*Commissioner of Patents and Trademarks*